US008082860B2

(12) United States Patent
Courtemanche et al.

(10) Patent No.: US 8,082,860 B2
(45) Date of Patent: Dec. 27, 2011

(54) ANTI-ROPING DEVICE FOR PULVERIZED COAL BURNERS

(75) Inventors: Bonnie Courtemanche, Holden, MA (US); Vlad Zarnescu, Worcester, MA (US); Craig A. Penterson, Sutton, MA (US)

(73) Assignee: Babcock Power Services Inc., Worcester, MA (US)

( * ) Notice: Subject to any disclaimer, the term of this patent is extended or adjusted under 35 U.S.C. 154(b) by 276 days.

(21) Appl. No.: 12/112,571

(22) Filed: Apr. 30, 2008

(65) Prior Publication Data

US 2009/0272303 A1 Nov. 5, 2009

(51) Int. Cl.
*F23D 1/00* (2006.01)
*F23K 1/00* (2006.01)

(52) U.S. Cl. ..... 110/263; 110/232; 110/347

(58) Field of Classification Search ..... 110/101 R, 110/261, 327, 341, 106, 101 CF, 104 R, 163, 110/232, 309, 313, 263, 347, 322; 138/40, 138/44, 45

See application file for complete search history.

(56) References Cited

U.S. PATENT DOCUMENTS

| | | | | |
|---|---|---|---|---|
| 1,315,719 | A | 9/1919 | Grindle | |
| 3,511,445 | A | 5/1970 | Ashdown | |
| 4,186,599 | A * | 2/1980 | Frick | 73/861.28 |
| 4,223,615 | A | 9/1980 | Breen et al. | |
| 4,380,202 | A | 4/1983 | LaRue et al. | |
| 5,421,274 | A * | 6/1995 | Gordon et al. | 110/232 |
| 5,568,777 | A | 10/1996 | Breen et al. | |
| 5,593,131 | A | 1/1997 | Briggs, Jr. et al. | |
| 5,685,240 | A | 11/1997 | Briggs, Jr. et al. | |
| 6,042,263 | A * | 3/2000 | Mentzer et al. | 366/340 |
| 6,109,781 | A | 8/2000 | Ogasawara et al. | |
| 6,234,090 | B1 | 5/2001 | Wark et al. | |
| 6,257,415 | B1 * | 7/2001 | Wark | 209/722 |
| 6,367,394 | B1 | 4/2002 | Kaneko et al. | |
| 6,474,250 | B1 | 11/2002 | Penterson et al. | |
| 6,588,598 | B2 * | 7/2003 | Wark | 209/143 |
| 6,607,079 | B2 | 8/2003 | Laux | |

(Continued)

FOREIGN PATENT DOCUMENTS

CA 2221158 A1 11/1996

(Continued)

OTHER PUBLICATIONS

International Search Report for PCT/US2009/053592, dated Mar. 17, 2010.

(Continued)

*Primary Examiner* — Kenneth Rinehart
*Assistant Examiner* — David J Laux
(74) *Attorney, Agent, or Firm* — Joshua L. Jones; Edwards Wildman Palmer LLP

(57) ABSTRACT

An orifice plate for improving particle distribution within a coal piping system includes a plate body defining a central orifice therethrough bounded by an inner periphery of the plate body. The plate body is configured and adapted to be affixed between end flanges of adjacent pipes in a coal piping system so as to generally align the central orifice with an internal flow passage through the coal piping system. Flow disruption features are defined in the inner periphery of the plate body. The flow disruption features are configured and adapted to disrupt a flow of air and particles flowing through the central orifice to provide a more uniform distribution of particles downstream of the plate body than upstream.

16 Claims, 4 Drawing Sheets

U.S. PATENT DOCUMENTS

| | | | | |
|---|---|---|---|---|
| 6,840,183 | B2 * | 1/2005 | Wark | 110/106 |
| 6,899,041 | B2 | 5/2005 | Wark | |
| 2002/0007859 | A1 | 1/2002 | Ta et al. | |
| 2005/0042043 | A1 | 2/2005 | Levy et al. | |
| 2007/0214896 | A1 * | 9/2007 | Orleskie et al. | 73/861.66 |

FOREIGN PATENT DOCUMENTS

| | | | |
|---|---|---|---|
| EP | 0076660 | A2 | 4/1983 |
| EP | 0272974 | A2 | 6/1988 |
| EP | 1143153 | A1 | 10/2001 |
| JP | 60188725 | A | 9/1985 |
| JP | 08296815 | | 11/1996 |
| JP | 10292903 | | 11/1998 |

OTHER PUBLICATIONS

Written Opinion of the International Searching Authority for PCT/US2009/053592, dated Mar. 17, 2010.

International Search Report for PCT/US09/37274, dated May 14, 2009.

Written Opinion of the Internatinal Searching Aurhority for PCT/US09/37274, dated May 14, 2009.

European Search Report dated Jun. 24, 2011 for European Application No. 09808619.2.

* cited by examiner

ANTI-ROPING DEVICE FOR PULVERIZED COAL BURNERS

BACKGROUND OF THE INVENTION

1. Field of the Invention

The present invention relates to pulverized coal burners, and more particularly, to systems for delivering pulverized coal to coal fired burners.

2. Description of Related Art

A variety of devices and methods are known in the art for delivering pulverized coal to coal fired burners. Of such devices, many are directed to improving particle distribution within coal piping systems for delivering coal to be combusted.

Coal powered plants require an efficient means of supplying coal as fuel to produce heat power. Raw coal is typically pulverized in a coal pulverizer or mill to produce small coal particles or coal dust. The pulverized coal must then be delivered to a furnace or burner where it can be used for combustion. This is typically done with a coal piping system that utilizes air flows to transport pulverized coal particles from the mill or pulverizer to a nozzle where coal particles are injected into the coal burner or furnace. As the coal particles travel in the air flow through the piping system, bends in the piping and the pipe geometry in general tend to cause non-uniform coal particle distribution. A densely packed region of coal particles extending through a piping system is referred to a coal "rope."

Coal roping causes various technical problems for operation and maintenance of coal systems. The poor distribution of coal particles can extend into the combustion zone, where localized imbalances in the fuel/air mixture tend to cause inefficient combustion and elevated emissions of $NO_X$, CO, and other pollutants. It can also cause elevated levels of unburned carbon in the fly ash, which will lower combustion efficiency. Also, the highly abrasive nature of the coal rope impacting and scrubbing components of the coal piping and burning system causes extensive erosion of pipes and other components in the system, leading to frequent need for inspection, repairs, and replacement of parts. If inspections, repairs and replacements are not performed in a timely manner, there is an elevated chance that abrasion from coal roping will cause expensive or dangerous failures of key components.

Various solutions to the coal roping problem are known in the art. One exemplary system is described in U.S. Pat. No. 6,840,183 to Wark, which describes a diffuser for pulverized coal delivery pipes for use between a piping elbow and a burner nozzle. The diffuser includes several diffuser bars running in line with the surrounding pipe, several radial collision-style diffuser rings attached at different points along the length of the diffuser bars, and a venturi ring upstream of the other components. The diffuser is configured to be installed downstream of an elbow in the pipes by opening the elbow, inserting the diffuser, and attaching the diffuser within the piping. When in place, the diffuser can improve particle distribution downstream of the elbow. The installation requires a pipe elbow that can be opened wide enough to admit the diffuser. The considerable length of the diffuser requires an accommodating length of straight pipe between the elbow and the burner nozzle. Moreover, the length of the diffuser, the multiple collision-style deflector rings and diffuser bars lead to inevitable pressure loss for the piping system. In a typical system, the diffuser described by Wark can impart a pressure loss of 3 in$H_2O$ or more.

Such conventional methods and systems generally have been considered satisfactory for their intended purpose. However, there still remains a continued need in the art for methods and devices that are easy to install and that can be used in a variety of systems. There also remains a need in the art for such methods and devices that impart low pressure drop, while improving coal particle distribution. The present invention provides a solution for these problems.

SUMMARY OF THE INVENTION

The subject invention is directed to a new and useful orifice plate for improving particle distribution within coal piping systems of pulverized coal burners. The orifice plate includes a plate body defining a central orifice therethrough bounded by an inner periphery of the plate body. The plate body is configured and adapted to be affixed between end flanges of adjacent pipes in a coal piping system so as to generally align the central orifice with an internal flow passage through the coal piping system. Flow disruption features are defined in the inner periphery of the plate body. The flow disruption features are configured and adapted to disrupt a flow of air and particles flowing through the central orifice to provide a more uniform distribution of particles downstream of the plate body than upstream.

In various embodiments, the inner periphery of the plate body includes at least one circular section and the flow disruption features include at least one flat section defined on a secant of a circle defined by the circular section. The flow disruption features can include two such flat sections substantially parallel and opposite to one another across the central orifice of the plate body. The flat sections of the inner periphery of the orifice plate can each have a length that is between about 65% and about 85% as long as the diameter of the circular section of the inner periphery, with lengths between about 70% and 80% as long as the diameter of the circular section being suitable for most applications.

The inner periphery of the plate body can include at least one circumferentially segmented section including a plurality of segments extending radially inward from an outer extent of the inner periphery of the plate body. The segmented section of the flow disruption features can be opposite the circular section across the central orifice of the plate body. It is contemplated that the segmented section of the flow disruption features can include three equally spaced segments. The segments can be between about 1.0 and 2.0 inches long inward from an outer extent of the inner periphery of the orifice plate, or any other suitable length.

In another aspect of the invention, the orifice plate can further include indexing means defined on the plate body, wherein the indexing means are configured and adapted to indicate orientation of the flow disruption features of the plate body. It is also envisioned that the orifice plate can farther include a handle on an outer periphery of the plate body, wherein the handle is configured and adapted to facilitate installation of the plate body between end flanges of two adjacent pipes. The handle can be circumferentially adjacent the circular section of the inner periphery of the plate body. The plate body can include steel, cast iron, Ni-Hard, hardened alloy plate, ceramic coating, tungsten cladding, weld overlay, and/or any other suitable material. The plate body can have a thickness through the central orifice of between about 0.5 inches and about 1.0 inches, or any other suitable thickness.

The invention also includes a system for delivering pulverized coal to a coal fired burner. The system includes a piping system configured and adapted to deliver pulverized coal to a coal fired burner. The piping system includes at least two pipe sections with adjacent end flanges configured and adapted to join adjacent pipe ends. An orifice plate is disposed between joined end flanges of two adjacent pipe sections in the piping system. The orifice plate defines a central orifice therethrough bounded by an inner periphery of the orifice plate. The central orifice is generally aligned with an internal flow passage through the piping system. The orifice plate of the system includes flow disruption features defined in the inner periphery thereof, as described above. A primary air nozzle can be operably connected to a burner end of the piping system for distributing coal particles issuing from the piping system into a coal fired burner. The orifice plate can be disposed between a pipe and an elbow pipe, or between any two other suitable components.

These and other features of the devices and methods of the subject invention will become more readily apparent to those skilled in the art from the following detailed description of the preferred embodiment taken in conjunction with the drawings.

BRIEF DESCRIPTION OF THE DRAWINGS

So that those skilled in the art to which the subject invention appertains will readily understand how to make and use the systems and devices of the subject invention without undue experimentation, preferred embodiments thereof will be described in detail herein below with reference to certain figures, wherein.

DETAILED DESCRIPTION OF THE PREFERRED EMBODIMENT

Figure 2:
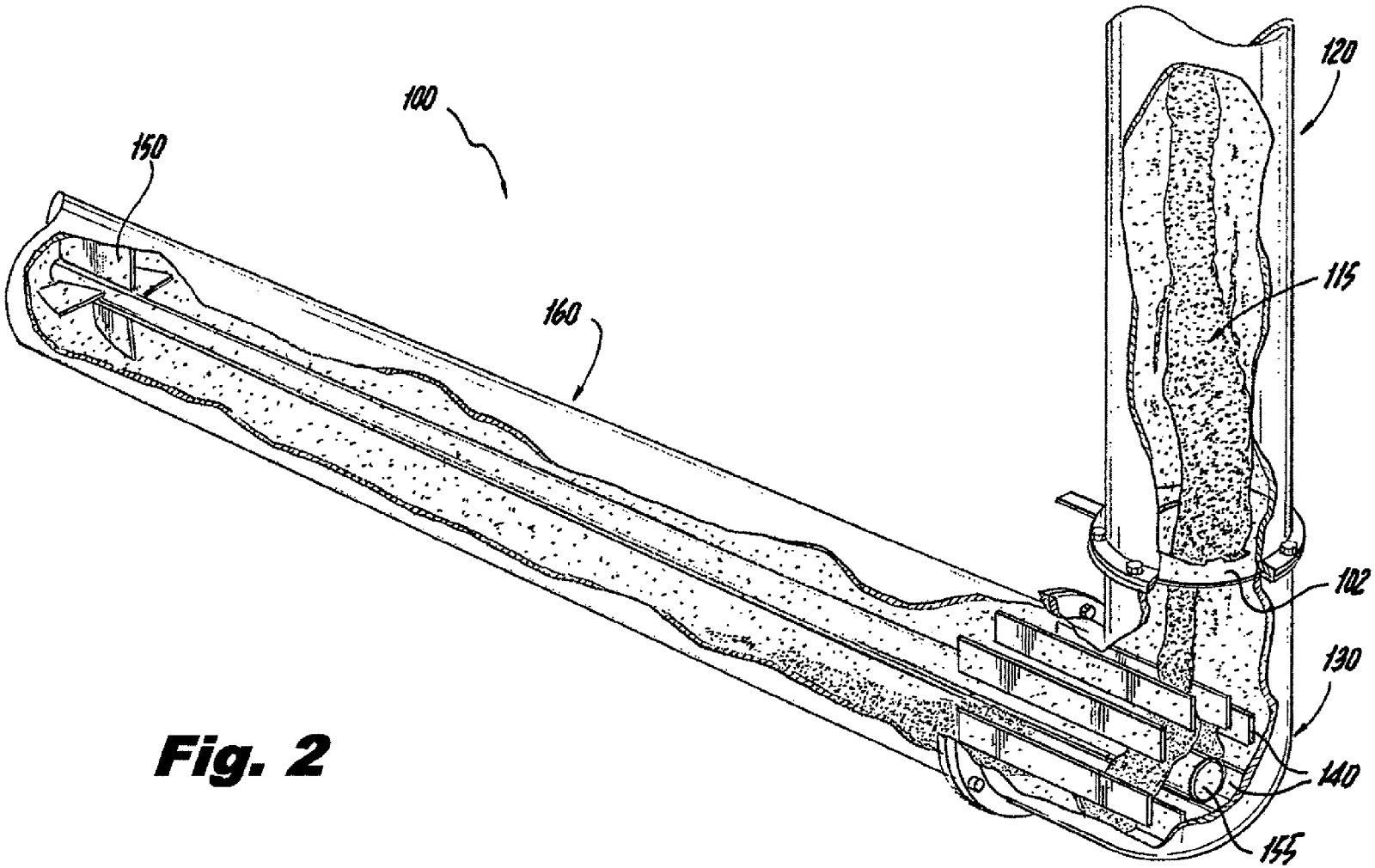
FIG. 2 is a cut away perspective view of a portion of a system for delivering pulverized coal to a coal fired burner constructed in accordance with the present invention, showing a coal rope upstream of an orifice plate and evenly distributed coal particle flow downstream of the orifice plate.

Reference will now be made to the drawings wherein like reference numerals identify similar structural features or aspects of the subject invention. For purpose of explanation and illustration, and not limitation, a partial view of an exemplary embodiment of the system in accordance with the invention is shown in FIG. 2 and is designated generally by reference character 100. Other embodiments of an orifice plate in accordance with the invention, or aspects thereof, are provided in FIGS. 3-6, as will be described. The system of the invention can be used in a variety of coal systems to provide improved coal particle distribution supplied to coal burners.

Figure 1:
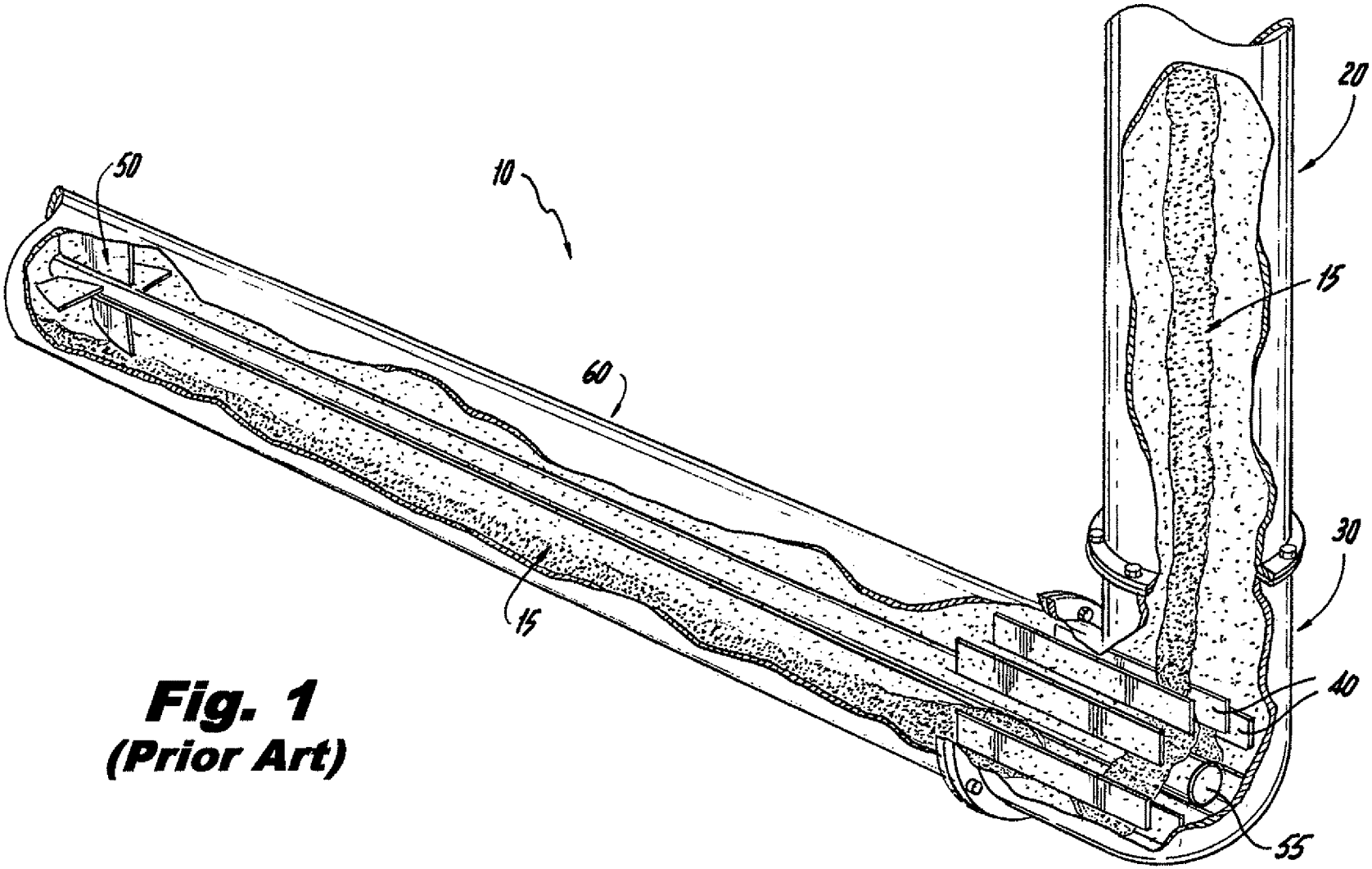
Fig. 1 (Prior Art)
FIG. 1 is a cut away perspective view of a portion of a coal piping system for delivering coal particles to a burner, showing a coal rope running throughout the pipes.

FIG. 1 shows a portion of an exemplary coal piping system 10 in a cut away perspective view with a representation of coal particles flowing therethrough. A coal rope 15 runs from upstream pipe 20, through elbow 30 and coal head vanes 40, to coal spreader 50 in downstream pipe 60, which incorporates a coal nozzle, just upstream of a burner. The nozzle and burner are not shown for sake of clarity. However, U.S. Pat. No. 6,474,250 to Penterson et al., which is incorporated by reference herein in its entirety, shows a suitable coal nozzle. Passing the corner in elbow 30 actually intensifies the concentration of the coal rope downstream at coal spreader 50. Coal rope 15 tends to flow off-center in downstream pipe 60, following along one side thereof.

FIG. 2 shows a schematic view of system 100 in accordance with the present invention. System 100 includes an upstream pipe 120 and a downstream pipe 160 joining an elbow 130. Coal head vanes 140, and a coal spreader 150 are also operably connected to system 100. System 100 is configured to conduct a stream of air and coal particles to a coal burner. A coal rope 115 exists in the particle flow upstream of an orifice plate 102, however, orifice plate 102 causes mixing/cross-mixing and redistribution of air and particles downstream of orifice plate 102. Coal rope 115 is dissipated between orifice plate 102 and coal spreader 150, and is almost completely eliminated as far upstream as the middle of downstream pipe 160. Thus in system 100, a substantially even distribution of air and coal particles is supplied to the downstream coal burner.

Figure 3:
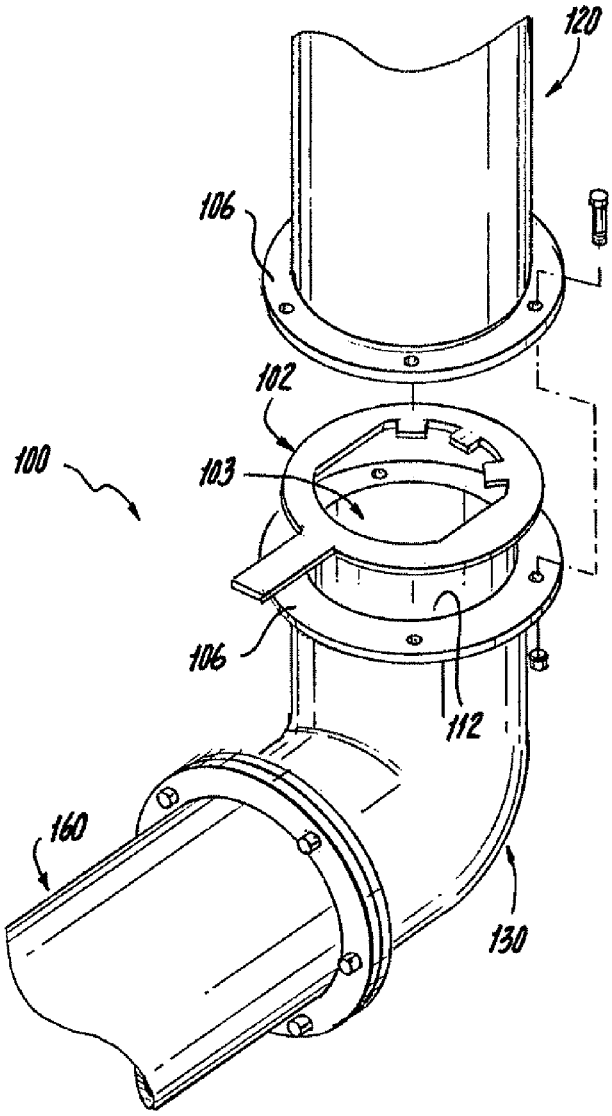
FIG. 3 is a perspective view of a portion of the system of FIG. 2, showing the orifice plate between pipe disconnected end flanges of adjacent pipes in a coal piping system.
Figure 4:
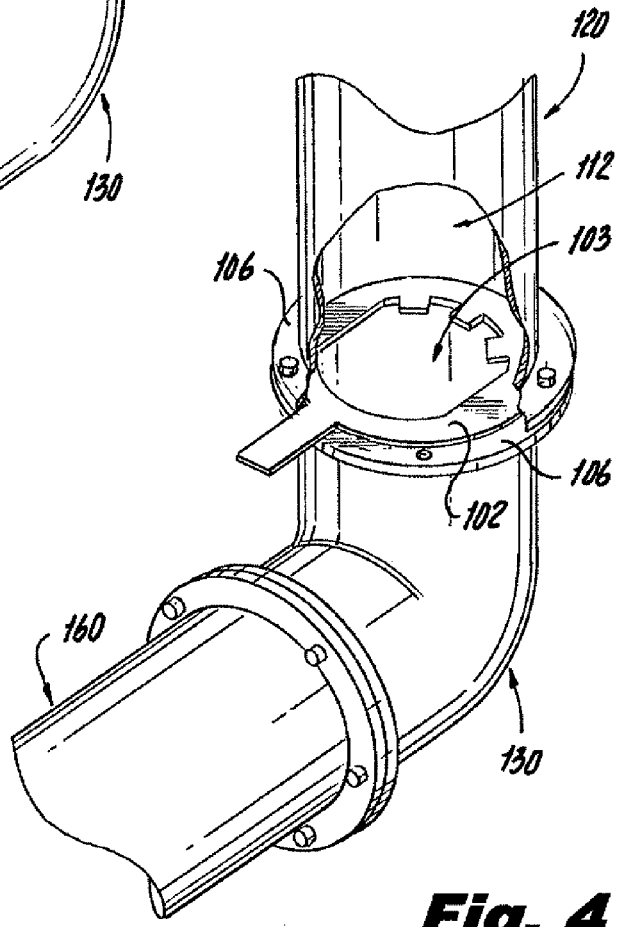
FIG. 4 is a perspective view of a portion of the system of FIG. 2, showing the plate affixed between pipe flanges in a coal piping system.

FIG. 3 shows orifice plate 102 between disconnected pipe flanges 106, as during installation or removal. FIG. 4 shows orifice plate 102 mounted between adjacent flanges 106 of upstream pipe 120 and elbow pipe 130 in system 100. Central orifice 103 of orifice plate 102 is generally aligned with an internal flow passage 112 through the coal piping system. Orifice plate 102 can be installed in new or existing systems, and system 100 as shown is exemplary. Those skilled in the art will appreciate that orifice plate 102 can be mounted in other locations within a coal piping system, and can also be used in different types of coal piping systems.

Generally there is enough play in the pipes of existing piping systems so that if flanges 106 of two connected pipes are disconnected (as in FIG. 3), orifice plate 102 can be inserted between disconnected flanges 106 and then flanges 106 can be reconnected affixing orifice plate 102 therebetween without substantial modifications to other portions of the system. Orifice plate 102 can be bolted with the same bolts holding flanges 106 together if orifice plate 106 includes bores, slots, or other means for bolts pass therethrough. It is also possible to simply press orifice plate 102 between tightly bolted flanges 106 without actually placing bolts through orifice plate 102, as shown in FIG. 4.

If orifice plate 102 must be inspected or replaced, flanges 106 can be unbolted and orifice plate 102 can be removed by separating it from flanges 106. The simplicity of installation and removal of orifice plate 102, as well as the fact that little or no modification is required for existing piping systems when orifice plate 102 is installed, make orifice plate 102 advantageous compared to diffuser systems known in the art. While shown in FIGS. 3 and 4 being mounted between flanges of upstream pipe 120 and pipe elbow 130, those skilled in the art will appreciate that orifice plate 102 can be mounted between any two components having similar flanges, including pipes, elbows, or other suitable components. Moreover, a specific piping system or configuration is not required, since orifice plate 102 can be used in a wide variety of systems having pipes or other components connected by means of flanges without the need for substantial modification of existing systems or designs.

A primary nozzle is operably connected to a burner end of the piping system for distributing coal particles issuing from the piping system into a coal fired burner. The improved distribution of coal particles in the piping system can be advantageously utilized in a wide variety of nozzles, injectors, coal heads, and other means of supplying coal particles to be combusted. Those skilled in the art will readily appreciate that any other suitable means of distributing or injecting coal particles and air into a coal burner can be used in conjunction with orifice plate 102 without departing from the spirit and scope of the invention.

Figure 5:
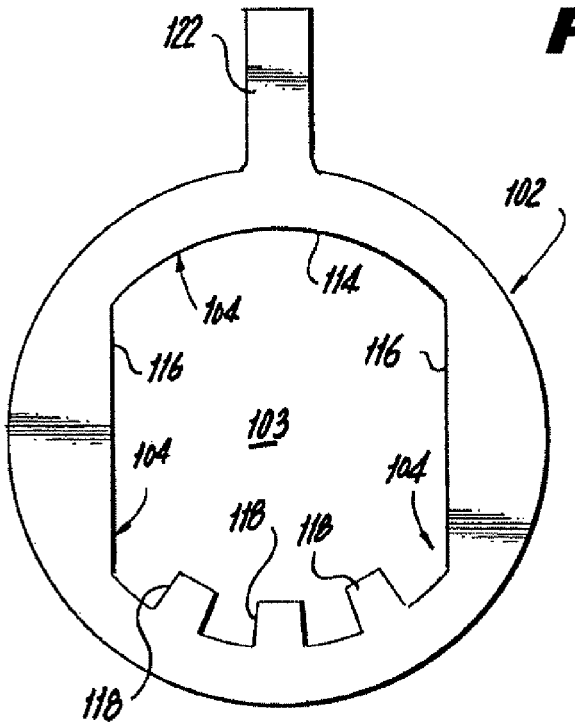
FIG. 5 is a front elevation view of a first representative embodiment of an orifice plate constructed in accordance with the present invention, showing flow disruption features defined in an inner periphery of the plate including a segmented section and two flat sections.

With reference now to FIG. 5, orifice plate 102 is configured and adapted to serve as an anti-roping measure and to improve particle distribution generally within a new or existing coal piping system. Orifice plate 102 includes a plate body defining a central orifice 103 therethrough bounded by an inner periphery 104 of plate body 102. A circular section 114 is defined on a portion of inner periphery 104. The diameter of circular section 114 can be from about 9.75 inches to about 24 inches depending on the dimensions of the coal piping system, and those skilled in the are will appreciate that any suitable diameter can be used for a given application. Flow disruption features are defined in inner periphery 104, including two flat sections 116 that are substantially parallel and opposite to one another across central orifice 103 of plate body 102. Flat sections 116 are defined on secants of the circle defined by circular section 114 of inner periphery 104. Flat sections 116 of inner periphery 104 each have a length that is about 79% of the length of the diameter of circular section 114. However, flat sections 116 can be between about 65% and about 85% as long as the first diameter of the flow disruption feature, or any other suitable length without departing from the spirit and scope of the invention. Moreover, flat sections 116 can be non-parallel without departing from the spirit and scope of the invention.

The flow disruption features of inner periphery 104 of plate body 102 include a circumferentially segmented section including a plurality of segments 118 extending radially inward from the outer extent of inner periphery 104. Segments 118 are opposite circular section 104 across central orifice 103. As shown in FIG. 5, the segmented section of the flow disruption features includes three equally spaced apart segments 118. The segments can be between about 1-2 inches long in the radial direction and between about 1.0-3.5 inches in the circumferential direction and they are evenly spaced. However, those skilled in the art will readily appreciate that the size, spacing, proportions, and number of segments can be varied without departing from the spirit and scope of the invention. Advantageously, plate body 102 is a single piece construction, allowing for ease of manufacture and use. However, it is also possible to construct a plate body in a multiple piece construction without departing from the spirit and scope of the invention.

Figure 6:
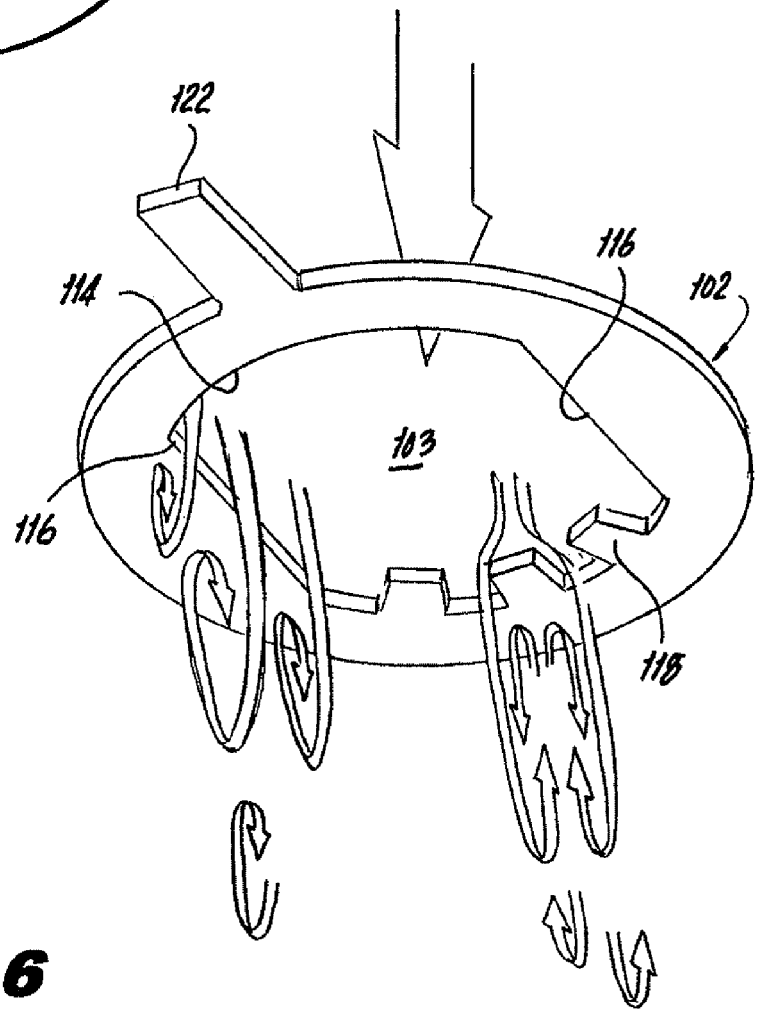
FIG. 6 is a perspective view of the orifice plate of FIG. 5, showing regions of turbulence and/or recirculation downstream of one of the flat sections and downstream of one of the segments of the segmented section of the inner periphery of the orifice plate.

FIG. 6 shows orifice plate 102 with arrows to represent how the flow disruption features 116/118 trip turbulence and cause eddies, vortices, and other such mixing and cross-mixing phenomena in the air flowing through the piping system. These flow disturbances downstream of orifice plate 102 affect the particle flow to promote mixing of particles and thereby to improve particle distribution within the air/particle flow downstream of orifice plate 102. Flow disruption features can also promote better particle distribution by direct impacting or collision of coal particles thereagainst. The flow disruption features provide a more uniform distribution of particles downstream of the plate body than upstream, as shown in FIG. 2.

Orifice plate 102 includes a handle 122 on an outer periphery thereof. Handle 122 is configured and adapted to facilitate installation of plate body 102 between end flanges 106 of two adjacent pipes 120/130. Handle 122 is shown in FIG. 5 to be circumferentially adjacent to circular section 114 of the inner periphery 104. In addition to facilitating installation and removal of orifice plate 102, handle 122 serves as an index for the orientation of the flow disruption features 116/118 within the flow passage of system 100. However, handle 122 can also be located at any other circumferential location on plate body 102 without departing from the spirit and scope of the invention.

It is generally advantageous to orient orifice plate 102 with segments 118 circumferentially oriented along a portion of pipes 120/130 where the coal rope tends to flow nearest the pipe walls. The location of the coal rope can vary from system to system, but can generally be determined from the last coal pipe bend before the site of orifice plate 102, or upstream elbow. While handle 122 provides the advantages of ease of installation and removal, as well as serving as an index, those skilled in the art will readily appreciate that handle 122 is an optional feature as it is possible to properly install/remove an orifice plate in accordance with the invention even without such a handle. Moreover, if a handle is not included, optionally any other visual, tactile, magnetic, electrical, or other suitable means can be included with plate body 102 to provide an index for the orientation of the flow disruption features inside a piping system.

The thickness of plate body 102 is between about 0.5-1.0 inches, however, any suitable dimensions can be used for a given piping system. The relatively thin dimension of plate body 102 and the configuration of the flow disruption features lead to a very low pressure drop in flow across plate body 102. In a typical system the pressure drop across plate body 102 can be as low as about 1.5 in$H_2O$. It is important for anti-roping devices to have low pressure drop, especially when used as a retrofit in existing systems which have limited fan capacity.

Plate body 102 includes materials suited for abrasion and impact of coal particles at high speeds. Suitable materials include steel, cast iron, Ni-Hard, hardened alloy plate, ceramic coating, tungsten cladding, and weld overlay. However, those skilled in the art will readily appreciate that any suitable materials can be used. It is also possible for orifice plate 102 to be made of multiple materials, for example a base material plated or covered with protective tiles or coatings of additional materials. Flow disruption features can be formed of one material, with the remainder of orifice plate 102 made of another material. In short, any suitable materials and dimensions can be used without departing from the spirit and scope of the invention, and those skilled in the art will readily appreciate how to configure orifice plates to withstand the abrasive environment of the various piping systems in which orifice plates in accordance with the invention can be used.

In summary, the subject invention includes a new and useful anti-roping system. The system includes an orifice plate for improving particle distribution within a coal piping system. The orifice plate includes a plate body defining a central orifice therethrough bounded by an inner periphery of the plate body. The plate body is configured and adapted to be affixed between end flanges of adjacent pipes in a coal piping system so as to generally align the central orifice with an internal flow passage through the coal piping system. Flow disruption features are defined in the inner periphery of the plate body. The flow disruption features are configured and adapted to disrupt a flow of air and particles flowing through the central orifice to provide a more uniform distribution of particles downstream of the plate body than upstream.

The methods and systems of the present invention, as described above and shown in the drawings, allow for supplying coal powered plants with coal/air flows having superior properties including more uniform distribution of both large and small coal particles. This improved particle distribution leads to improved operability and combustion efficiency, lower emissions of $NO_X$, CO, and other pollutants, and reduced local and overall abrasion/erosion in the coal piping system. The single piece construction possible for the orifice plate provide for cost effective construction and installation. Moreover, the methods and systems of the present invention provide these advantages while also being easy to install and use in a wide variety of systems when compared with known devices.

While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. An orifice plate for improving particle distribution within a coal piping system comprising:

a) a plate body defining a single central orifice therethrough bounded by an inner periphery of the plate body, wherein the plate body is configured and adapted to be affixed between end flanges of adjacent pipes in a coal piping system so as to generally align the single central orifice with an internal flow passage through the coal piping system; and b) flow disruption features defined in the inner periphery of the plate body, wherein the flow disruption features are configured and adapted to disrupt a flow of air and particles flowing through the single central orifice to provide a more uniform distribution of particles downstream of the plate body than upstream, wherein the flow disruption features include a circumferentially segmented portion and define an inner periphery geometry that is substantially symmetrical about only one axis of symmetry in a plane defined by the single central orifice for orientation of the segmented portion along a portion of adjacent coal pipes where a coal rope tends to flow nearest adjacent pipe walls, and wherein the flow disruption features are all defined in the inner periphery of the same single central orifice through the plate body.

2. An orifice plate for improving particle distribution within a coal piping system comprising:

a) a plate body defining a single central orifice therethrough bounded by an inner periphery of the plate body, wherein the plate body is configured and adapted to be affixed between end flanges of adjacent pipes in a coal piping system so as to generally align the single central orifice with an internal flow passage through the coal piping system; and b) flow disruption features defined in the inner periphery of the plate body, wherein the flow disruption features are configured and adapted to disrupt a flow of air and particles flowing through the single central orifice to provide a more uniform distribution of particles downstream of the plate body than upstream, wherein the flow disruption features include two non-segmented flat sections substantially parallel and opposite to one another across the single central orifice of the plate body, and wherein the inner periphery of the plate body includes at least one circumferentially segmented section including a plurality of segments extending radially inward from an outer extent of the inner periphery of the plate body, wherein the circumferentially segmented section is between the two flat sections circumferentially, and wherein the two flat sections and the circumferentially segmented section are all defined in the inner periphery of the same single central orifice through the plate body.

3. An orifice plate as recited in claim 2, wherein the inner periphery of the plate body includes at least one circular section circumferentially between the two flat sections.

4. An orifice plate as recited in claim 2, further comprising indexing means defined on the plate body, wherein the indexing means are configured and adapted to indicate orientation of the flow disruption features of the plate body.

5. An orifice plate as recited in claim 2, wherein the plate body includes at least one material selected from the group consisting of: steel, cast iron, Ni-Hard, hardened alloy plate, ceramic coating, tungsten cladding, and weld overlay.

6. An orifice plate for improving particle distribution within a coal piping system comprising:

a) a plate body defining a single central orifice therethrough bounded by an inner periphery of the plate body, wherein the plate body is configured and adapted to be affixed between end flanges of adjacent pipes in a coal piping system so as to generally align the single central orifice with an internal flow passage through the coal piping system; and b) flow disruption features defined in the inner periphery of the plate body, wherein the flow disruption features are configured and adapted to disrupt a flow of air and particles flowing through the single central orifice to provide a more uniform distribution of particles downstream of the plate body than upstream, the flow disruption features including:

i) a circular section defined along a circle having a first diameter;

ii) two substantially parallel non-segmented flat sections opposite to one another across the single central orifice of the plate body, the flat sections being defined on secants of a circle defined by the circular section; and iii) a circumferentially segmented section including a plurality of segments extending radially inward from an outer extent of the inner periphery of the plate body, wherein the circumferentially segmented section is between the two flat sections circumferentially, and wherein the two flat sections and the circumferentially segmented section are all defined in the inner periphery of the same single central orifice through the plate body.

7. An orifice plate as recited in claim 6, wherein the plate body has a thickness through the single central orifice of between about 0.5 inches and about 1.0 inches.

8. An orifice plate as recited in claim 6, wherein the segmented section of the flow disruption features is opposite the circular section across the single central orifice of the plate body.

9. An orifice plate as recited in claim 8, further comprising a handle on an outer periphery of the plate body circumferentially adjacent the circular section of the inner periphery of the plate body.

10. An orifice plate as recited in claim 9, wherein the segmented section of the flow disruption features includes three equally spaced apart segments.

11. An orifice plate as recited in claim 6, wherein the segments are between about 1.0 inches and 2.0 inches long inward from an outer extent of the inner periphery of the orifice plate.

12. An orifice plate as recited in claim 6, wherein the flat sections of the inner periphery of the orifice plate each have a length that is between about 65% and about 85% as long as the first diameter of the circular section of the inner periphery.

13. A system for delivering pulverized coal to a coal fired burner comprising:

a) a piping system configured and adapted to deliver pulverized coal to a coal fired burner, the piping system including at least two pipe sections with adjacent end flanges configured and adapted to join adjacent pipe ends; and b) an orifice plate disposed between joined end flanges of two adjacent pipe sections in the piping system, the orifice plate defining a single central orifice therethrough bounded by an inner periphery of the orifice plate, wherein the single central orifice is generally aligned with an internal flow passage through the piping system, the orifice plate including flow disruption features defined in the inner periphery thereof, wherein the flow disruption features are configured and adapted to disrupt a flow of air and particles flowing through the single central orifice to provide a more uniform distribution of particles downstream of the orifice plate than upstream, wherein the flow disruption features include two non-segmented flat sections substantially parallel and opposite to one another across the single central orifice of the plate body, wherein the inner periphery of the plate body includes at least one circumferentially segmented section including a plurality of segments extending radially inward from an outer extent of the inner periphery of the plate body, wherein the circumferentially segmented section is between the two flat sections circumferentially, and wherein the two flat sections and the circumferentially segmented section are all defined in the inner periphery of the same single central orifice through the plate body.

14. A system as recited in claim 13, wherein the inner periphery of the orifice plate includes at least one circular section circumferentially between the two flat sections.

15. A system as recited in claim 13, wherein the orifice plate is disposed between joined end flanges of two adjacent pipe sections that include a pipe and an elbow pipe.

16. A system as recited in claim 13, wherein the orifice plate includes at least one material selected from the group consisting of: steel, cast iron, Ni-Hard, hardened alloy plate, ceramic coating, tungsten cladding, and weld overlay.

* * * * *